US006284958B1

(12) United States Patent
Aoki et al.

(10) Patent No.: US 6,284,958 B1
(45) Date of Patent: Sep. 4, 2001

(54) TONE HOLE PAD FOR A WIND INSTRUMENT AND METHOD OF ADJUSTING TOUCH

(75) Inventors: Hiroshi Aoki; Makoto Oyauchi, both of Tokorozawa (JP)

(73) Assignee: Muramatsu Flute Manufacturing Co., Ltd., Saitama (JP)

( * ) Notice: Subject to any disclaimer, the term of this patent is extended or adjusted under 35 U.S.C. 154(b) by 0 days.

(21) Appl. No.: 09/513,197

(22) Filed: Feb. 25, 2000

(30) Foreign Application Priority Data

Apr. 9, 1999 (JP) ..... 11-137573

(51) Int. Cl.[7] ..... G10D 7/08
(52) U.S. Cl. ..... 84/385 P; 84/85 A
(58) Field of Search ..... 84/385 A, 385 P; D17/99

(56) References Cited

U.S. PATENT DOCUMENTS

| | | | | |
|---|---|---|---|---|
| 3,295,403 | * | 1/1967 | Kindlesparker | 84/385 |
| 3,668,633 | * | 9/1972 | Nagao | 84/380 |
| 4,967,632 | * | 11/1990 | Etheridge, III et al. | 84/385 P |
| 5,183,954 | * | 2/1993 | Wasser | 84/385 P |
| 5,417,135 | * | 5/1995 | Straubinger | 84/385 P |
| 5,469,771 | * | 11/1995 | Wasser | 84/385 P |
| 6,015,946 | * | 1/2000 | Yamaryo | 84/380 R |
| 6,028,256 | * | 2/2000 | Straubinger | 84/385 P |

* cited by examiner

*Primary Examiner*—Robert E. Nappi
*Assistant Examiner*—Kim Lockett
(74) *Attorney, Agent, or Firm*—Wenderoth, Lind & Ponack, L.L.P.

(57) ABSTRACT

A tone hole pad for a musical wind instrument is mounted inside a cup to open/close a tone hole. The tone hole pad is capable of producing an accurate sound without needing fine adjustments. A method of touch adjustment of the tone hole pad is also provided. This pad includes a circular metallic base 8 in which, a rising wall portion 5 is formed on an outer peripheral portion of a surface thereof. A ring-like concave portion 6 is formed which has an outside diameter just inside the rising wall portion and an inside diameter smaller than the tone hole 2. The concave portion 6 has an appropriate width and depth. A ring-like convex portion 7 is formed on a peripheral portion of a rear surface. A resin plate 10, in which a hole 4 is formed in the center thereof, is firmly fitted to the surface of the metallic base 8 such that it covers the surface. The resin plate 10 is inserted inside the metallic base 8 so as to form a space portion 9 in the ring-like concave portion 6. A rear face of a circular felt-like fiber body 11 is firmly fitted to the surface of the resin plate 10. The fiber body 11 is inserted inside the metallic base 8. A mount paper 12 is firmly fitted to the rear surface of the metallic base 8 such that the hole 4 is fixed to the ring-like convex portion 7. A pad skin 13 which wraps the above three components from the surfaces thereof and is glued to the mount paper 12.

9 Claims, 6 Drawing Sheets

TONE HOLE PAD FOR A WIND INSTRUMENT AND METHOD OF ADJUSTING TOUCH

BACKGROUND OF THE INVENTION

1. Field of the Invention

The present invention relates to a tone hole pad for a musical wind instrument which is mounted within a cup for opening or closing a tone hole and a method of touch (feeling) adjustment therefor.

2. Description of the Prior Art

In an old style musical wind instrument (until about 1800), the diameter of tone holes formed on side face thereof is very small and a distance between the tone holes on both sides is short so that the holes can be reached by extending a finger. An instrument player changes a produced sound by changing the effective length of a wind instrument pipe by opening or closing the tone holes directly. Because a finger pad is deformed corresponding to the shape of the tone hole, the tone hole can be sealed completely with a light touch (pressure).

However, to produce accurate half tones or generate larger sounds, various modifications were applied to wind instruments so that their length was gradually increased. As a result, the diameter of the tone hole has increased and the distance between the tone holes on both sides has tended to increase in order to create todays style of wind instruments. Because of this style, a tone. hole cannot be opened or closed directly by a finger. Today's wind instruments have been constructed so that when a lever is pressed by a finger, the generated force is transmitted via the lever and applied and applied onto the top face of the tone hole. The tone hole is then opened or closed by a pad mounted on an inner face of a cup.

As a result of a number of trial productions, a currently standard pad (about 3 mm in thickness) has the following structure (see FIGS. 14–15). A piece of felt 21 (about 2 mm in thickness) is mounted on a mount paper 22. A pad skin 23 (thin cover) is then placed so as to wrap the felt 21 and is glued to the mount paper (about 1 mm in thickness). A hole 25 is located in the center of the pad (see FIG. 14). A side of the mount paper 22 of the pad is mounted in a cup 24 and another side of the felt 21 contacts the tone hole.

The pad is inserted in the cup 24 and a pad nut 26 is inserted into the hole 25 for mounting in the center of the pad. Then, a pad washer 27 having a smaller outer diameter than the tone hole is placed thereon and finally tightened with a pad fastening screw 28 to the cup 24. A gap between the pad and cup 24 is filled with adjustment paper 29 (see FIG. 15). Adjustment to a desired finger touch for an instrument player is done by reducing the thickness of the felt 21 or using a rigid felt 21 so as to harden the touch, or by increasing the thickness the felt 21 or using soft felt 21 so as to soften the touch.

The above-described conventional wind instrument pad and touch adjustment method have the following problems.

One of the problems is that the pad cannot cope with distortion of the tone hole so that a gap is produced therearound. The tone holes of the wind instrument are cylindrical holes formed integrally on a side face thereof. In a metal instrument, it is almost impossible to process a top face of the tone hole completely flat. Therefore, some distortion is always produced. In a wooden instrument a mountain portion and a valley portion are formed on the top face of the tone hole because of distortions in the wood and the grain of the wood. The pad does not come into firm contact with the valley portion due to these distortions, and thereby produces a gap.

Another problem is that the cup supporting the pad cannot be mounted completely parallel to the tone hole. Because the cup makes a circular motion around a fulcrum of a lever, if the pad is thick, a portion of the pad near the fulcrum comes into contact with the tone hole so that a gap is produced in a portion of the pad away from the fulcrum. In case of a thin pad, a portion of the pad away from the fulcrum comes into contact with the tone hole so that a gap is produced in a portion of the pad near the fulcrum.

Still another problem is that the felt occupying most of the pad cannot maintain a constant shape so that the pad is deformed, and consequently the pad itself is also deformed and cannot be restored. As a result, a firm contact with the tone hole is lost. Because the felt is as thick as about 2 mm, the deformation thereof largely affects the fin contact. The felt is likely to be affected by the humidity, and if the humidity rises, the felt absorbs water so as to become thicker. If the humidity drops, the felt is dried and contracted. Further, the felt is physically pressed by pressure applied when the instrument is played, so that it is deformed. In the deformed felt surface, a dented valley portion and a swollen mountain portion are generated. If the pad is deformed and deteriorated, it is not capable of closing the top face of the tone hole properly so that there is produced a gap therearound.

Still another problem is that to intensify contact performance between the pad and tone hole, instrument players must increase their finger touch (pressure) using only the elasticity of the felt. To produce a better sound by accommodating the distortion of the tone hole and deformation of the pad, the pad needs to be pressed firmly against the top face of the tone hole so as to close it. However, when a quick passage is played, it is difficult to enhance the finger touch. Additionally, a violent and strong touch quickens deterioration and deformation of the pad. It is found that a wind instrument player needs to have more physical strength and technique than properly is required. Further, sound produced by the contact between the pad and tone hole by a strong touch produces noise. Although it is ideal that the player can obtain a feeling that the tone hole is completely closed with the player's finger through the pad, the finger does not receive such a feeling that it is completely closing the tone hole, because the cup needs to be pressed firmly.

A further problem is that a slight amount of air may invade through a gap between the pad surface and rear surface of the pad washer, pass through a gap between a pad hole and pad nut, and leak out through a gap between an outer peripheral face and the cup (including the adjusting mount paper) from the pad rear surface. This, also, results in deterioration of sound quality.

A further problem is that the mount paper deflects from the center of the pad, because the felt and mount paper are not fastened. Consequently, a deflection occurs due to the tension of the pad skin so that the pad shape cannot be maintained properly, and the pad is deformed so as to produce a gap.

A further problem is that pressure for mounting the pad is not uniform. Only the center portion of the pad is pressed firmly against the cup by a pressure of the pad washer. Because the felt and mount paper of the pad are not hard, pressure of the pad washer is concentrated around the center of the pad and it is weaker near the periphery thereof. Because the pad is warped and the periphery thereof is distorted by the deflection due to the pressure, there is produced a gap between the pad and tone hole so that the pad cannot have a firm contact.

A further problem is that air leaks so that an accurate sound is not produced. Unless the tone hole is closed completely by the pad, no accurate sound can be produced. The conventional pad cannot close the gap completely and is incapable of producing an accurate sound.

A further problem is that it is periodically necessary to carry out fine adjustments of the unevenness produced on the surface of the pad by creating an uneven inner surface of the cup, by mounting an adjustment paper, and by mounting the pad thereon. In this adjustment, an adjustment paper having a thickness of about 0.005 mm is mounted on the inner surface of the cup which contacts a retracted portion of the tone hole so as to produce unevenness on the surface of the pad. This work requires skill and time. Although this fine adjustment allows the tone hole to be closed firmly, the pad is deformed and deteriorated, because of the aforementioned reasons so that a gap is produced. In the worst case, with a single play after such a fine adjustment, the generation of accurate sound is disabled.

A further problem is that adjustment of the touch requires skill, and that thick soft felt tends to be largely deformed while thin solid felt tends to have lower contact performance. Further, there is a problem that other touch characteristics (other than solid and soft) such as shallow touch or deep touch cannot be adjusted.

SUMMARY OF THE INVENTION

Accordingly, an object of the invention is to provide a tone hole pad for a musical wind instrument that has solved the above problems, and a method of touch adjustment therefor.

To achieve the above object, according to a first aspect of the invention, there is provided a tone hole pad for a wind instrument, and a rear face of which is mounted inside a cup of the wind instrument for opening/closing a tone hole with a front face of the pad. The pad includes a circular metallic base in which a hole is formed in the center thereof. A rising wall portion having an inside diameter larger than the tone hole is formed on an outer peripheral portion of a flat surface thereof A ring-like concave portion having an outside diameter just inside the rising wall portion and an inside diameter smaller than the tone hole is formed in the metallic base. The concave portion having appropriate width and depth is formed inside the rising wall portion of a surface thereof and a ring-like convex portion is formed on an inner peripheral portion of a flat rear surface thereof.

An elastic flat circular resin plate in which a hole having the same inside diameter as that of the metallic base is formed in the center thereof. An outer diameter thereof is substantially the same It has the inside diameter of the rising wall portion, and a rear f ace thereof is firmly fitted to the surf ace of the metallic base such that it covers the surface. The flat circular resin plate is inserted inside the metallic base so as to form a space portion in the ring-like concave portion.

A circular felt-like fiber body in which a hole having the same inside diameter as that of the resin plate is formed in the center thereof, and an outer diameter thereof is substantially the same as the inside diameter of the rising wall portion. A rear face thereof is firmly fitted to the surface of the resin plate, and the fiber body is inserted inside the metallic base.

A circular mount paper in which a hole having the same inside diameter as the outside diameter of the ring-like convex portion is formed in the center thereof, and an outer diameter thereof is substantially the same as the outside diameter of the metallic base and its surface is firmly fitted to the rear surface of the metallic base such that the hole is fixed to the ring-like convex portion. A hole having substantially the same inside diameter as that of the fiber body is formed in the center of a pad skin. The pad skin wraps the integrated fiber body, resin plate, metallic base and mount paper from the surfaces thereof, and maintains a uniform tension. The pad skin is glued to the rear surface of the mount paper, and the rising wall portion stabilizes the shapes of the resin plate and fiber body. The metallic base serves as a foundation for maintaining the shape of the pad, and the resin plate absorbs shock caused when the tone hole is closed while it is deformed so as to correspond to the shape of an upper face of the tone hole. The space portion of the ring-like concave portion allows deformation of the resin plate (as a space for escape). The fiber body completes a sealing contact with the pad skin by being pressed to an upper face of the tone hole by the elasticity of the resin plate. The ring-like convex portion maintains the center of the mount paper at a normal position. The pad skin holds a predetermined shape so as to maintain a uniform tension with the surface of the fiber body wrapped thereby, the outer peripheral face of the rising wall portion, and the rear surface of the mount paper on which the pad skin is glued.

According to a second aspect of the present invention, there is provided a tone hole pad for a wind instrument, and a rear face of which is mounted inside a cup of the wind instrument for opening/closing a tone hole with a front face of the pad. The pad includes a circular metallic base in which a hole is formed in the center thereof. A rising wall portion having an inside diameter larger than the tone hole is formed on an outer peripheral portion of a flat surface thereof and inclined inward such that an inside diameter of an upper portion thereof is smaller than that of a bottom portion thereof. A ring-like concave portion has an outside diameter just inside the rising wall portion and an inside diameter smaller than the tone hole. The concave portion having an appropriate width and depth is formed inside the rising wall portion of a surface thereof, and a ringlike convex portion is formed on an inner peripheral portion of a flat rear surface thereof.

Further, the pad includes a flat circular resin plate having an elasticity in which a hole having the same inside diameter as that of the metallic base is formed in the center thereof. An outer diameter thereof is substantially the same as the inside diameter of the rising wall portion, and a rear face thereof is firmly fitted to the surface of the metallic base such that it covers the surface. The flat circular resin plate is inserted inside the metallic base so as to form a space portion in a ring-like concave portion. A circular felt-like fiber body in which a hole having the same inside diameter as that of the resin plate is formed in the center thereof, and an outer diameter thereof is substantially the same as the inside diameter of the rising wall portion. A rear face thereof is firmly fitted to the surface of the resin plate. The fiber body is inserted inside the metallic base. A circular mount paper includes a hole having the same inside diameter as the outside diameter of the ring-like convex portion is formed in the center thereof. An outer diameter of the mount paper is substantially the same as the outside diameter of the metallic base and the surface of the mount paper is firmly fitted to the rear surface of the metallic base such that the hole is fixed to the ring-like convex portion.

A pad skin includes a hole having substantially the same inside diameter as that of the fiber body formed in the center thereof and wraps the integrated fiber body, resin plate, metallic base and mount paper from the surfaces thereof so as to maintain a uniform tension. The pad skin is glued to the rear surface of the mount paper, and the rising wall portion stabilizes the shapes of the resin plate and fiber body such that an inclined inside face thereof holds the resin plate and the fiber body to prevent the resin plate and fiber body from floating. The metallic base serves as a foundation for maintaining the shape of the pad. The resin plate absorbs shock caused when the tone hole is closed, and it is deformed so as to correspond to the shape of an upper face of the tone hole. The space portion of the ring-like concave portion allows for deformation of the resin plate (by acting as a space for escape). The fiber body completes a sealing contact with the pad skin pressed to an upper face of the tone hole by the elasticity of the resin plate. The ring-like convex portion maintains the center of the mount paper at a normal position. The pad skin holds a predetermined shape so as to maintain uniform tension with the surface of the fiber body wrapped thereby, the outer peripheral face of the rising wall portion, and the rear surface of the mount paper on which the pad skin is glued.

According to a third aspect of the present invention, there is provided a tone hole pad for a wind instrument as described in the first or second aspect further comprising a ring-like small protrusion formed on an inner peripheral portion of a flat surface of the metallic base. The inner peripheral portion of the surface of the pad is strongly pressed against the rear surface of the pad washer by the ring-like small protrusion when the pad is mounted to the cup so as to reduce air leakage.

According to a fourth aspect of the present invention, there is provided a method of touch adjustment for a tone hole pad for a wind instrument as described in the first, second and third aspects. Touch is made harder by narrowing the width of the ring-like concave portion to shorten a warpage width of the resin plate so as to harden the elastic force. The touch is made softer by widening the width of the ring-like concave portion to lengthen the warpage width of the resin plate so as to soften the elastic force. Further, the touch is made shallower by reducing the depth of the ring-like concave portion so that the movement of the resin plate into the space portion is made shallower. The touch is made deeper by deepening the depth of the ring-like concave portion so that the movement of the resin plate into the space portion is made deeper.

The basic mounting method of the above-described pad for a wind instrument on the cup is the same as for the conventional pad (see FIGS. 1, 2). Even if there is a distortion on the tone hole, the surface of the pad is elastically deformed to not produce a gap and to seal it completely (see FIG. 2).

The cup makes a circular motion around a fulcrum of a lever. Even if the pad makes contact in a condition in which the top surface of the tone hole is not parallel to the surface of the pad, the surface of the pad is elastically deformed so that it firmly contacts the top surface of the tone hole to not produce any gap. Thus, the tone hole can be sealed completely. Further, because the felt has a thin structure, the thickness of the pad does not change so much to produce an obstacle to the firm contact by the circular motion.

Although the thickness of the pad is not different from the conventional one, because the fiber body has a thin structure occupying only the upper layer, which is a part of a three-layer structure constituting the internal configuration of the pad, the sealing performance thereof is not affected by humidity. Further, because of the thin structure, the deformation of the fiber body by physical pressure is small so that the sealing performance is not affected. Because the fiber body absorbs shock integrally with the resin plate and is deformed, damage received thereby is small. The rising wall portion, which is inclined inward, holds the fiber body and resin plate so as to prevent floating of the outer peripheral ends thereof, and deformation of the fiber body and resin plate.

Because the fiber body and resin plate ensure the sealing performance and elasticity separately, a violent (strong) touch is not required, and therefore, the tone hole can be sealed securely with a light touch. Thus, the force of the finger during playing may be small. Because the tone hole can be opened/closed with the light touch and the resin plate absorbs the shock between the pad and tone hole, noise is not produced. Further, because the tone hole can be sealed with such a light touch, the player can feel that it is sealed completely (see FIG. 2).

The ring-like small protrusion formed on the metallic base presses the resin plate and the resin plate presses the pad skin. Therefore, when the pad is mounted in the cup, the ring-like small protrusion strongly presses the inner peripheral portion of the surface of the pad against the rear surface of the pad washer so as to prevent air leakage (see FIGS. 1, 2).

The ring-like convex shape maintains the center of the mount paper at a normal position. The pad skin maintains a predetermined shape with the surface, the wrapped fiber body, the outer peripheral face of the rising wall portion and the rear surface of the mount paper on which the pad skin is glued so as to maintain uniform tension, and thereby keep the shape of the pad.

Because the metallic base is solid, pressure by the pad washer is transmitted to the entire pad so that the pad is mounted within the cup with the entire inside face of the cup is pressed uniformly (see FIG. 1). Because the pad is not deformed by mounting pressure, the tone hole can be sealed without any gap. Because the tone hole is sealed completely with the pad so that no air leakage occurs, accurate sound can be produced.

Because the resin plate is deformed corresponding to the shape of the tone hole, fine adjustments with an adjustment paper requiring skill are not necessary. Even if the tone hole is distorted in any shape, it can be sealed. Additionally, anyone can mount the pad by only fixing it in the cup with a screw. Accurate sound can be produced at any time without fine adjustments. If the pad is consumed due to long term use, it can be replaced with a new one easily.

Depending on a player's desire, it is possible to adjust the touch by forming the width of the ring-like concave portion narrow to shorten the warpage width of the resin plate to make a solid touch. Forming the width of the ring-like concave portion wide to lengthen the warpage width of the resin plate makes a soft touch. Making the depth of the ring-like concave portion shallow makes a shallow touch, and making the depth of the ring-like concave portion deep makes a deep touch.

DESCRIPTION OF THE PREFERRED EMBODIMENTS

The embodiments of the present invention will be described with reference to the accompanying drawings. However, it is needless to say that the present invention is not restricted to the embodiments described below.

Figure 8:
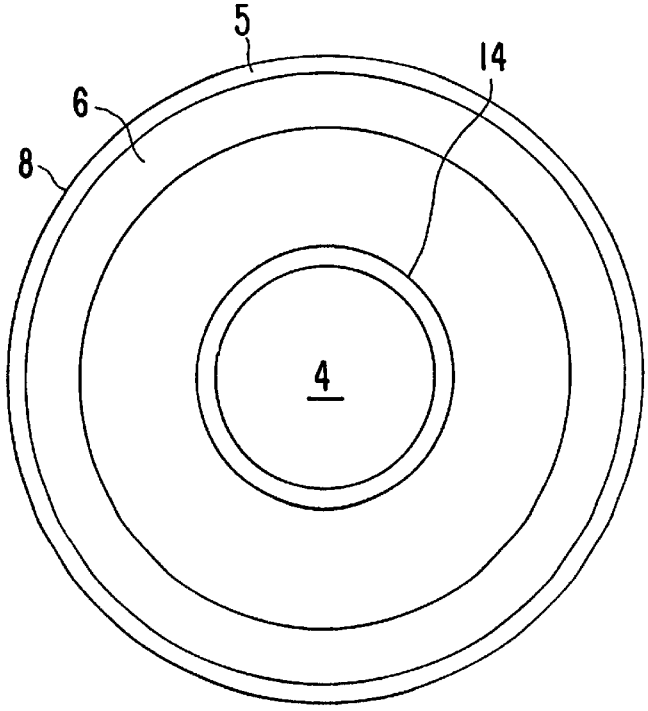
FIG. 8 is a plan view of the metallic base.
Figure 9:
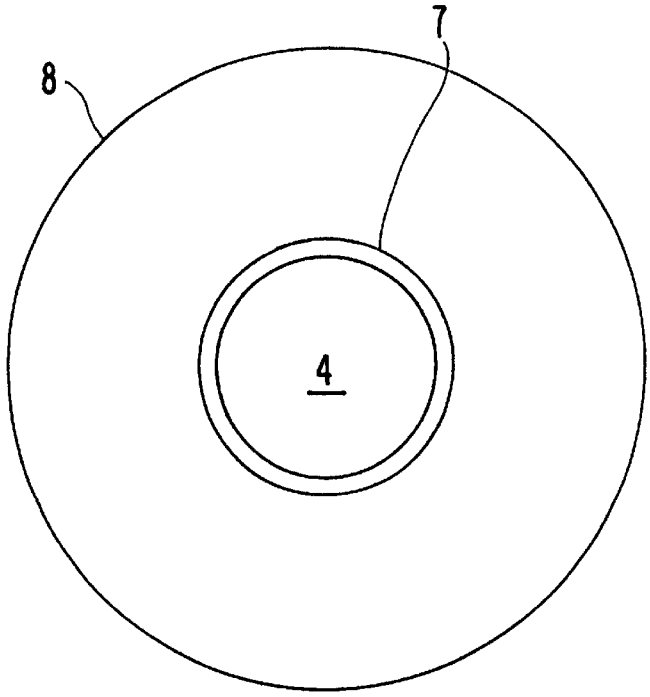
FIG. 9 is a bottom view of the metallic base.

FIG. 8 shows a metallic base 8, and a mounting hole 4 formed in the center thereof. An outer periphery thereof having a flat surface has an inside diameter larger than a tone hole 2 (see FIG. 1). This outer periphery forms a wall portion 5 inclined inward while the inside diameter of a bottom portion thereof is smaller than that of an upper portion thereof. Inside the rising wall portion 5 is formed a ring-like concave portion 6 having an outside diameter just inside the rising wall portion 5 and an inside diameter smaller than the tone hole 2. The concave portion 6 has an appropriate width and depth. On an inner periphery of a flat rear surface is formed a ring-like convex portion 7. This metallic base 8 is hard, and therefore, never deforms. A resin plate 10 and a fiber body 11 are inserted inside the surface of the metallic base 8. The inclination inside the rising wall portion 5 prevents the resin plate 10 and fiber body 11 from floating. The ring-like concave portion 6 of this embodiment has an inclination in which the inside thereof is shallow and the outside thereof is deep. This is where the resin plate 10 is likely to warp during use.

Figure 2:
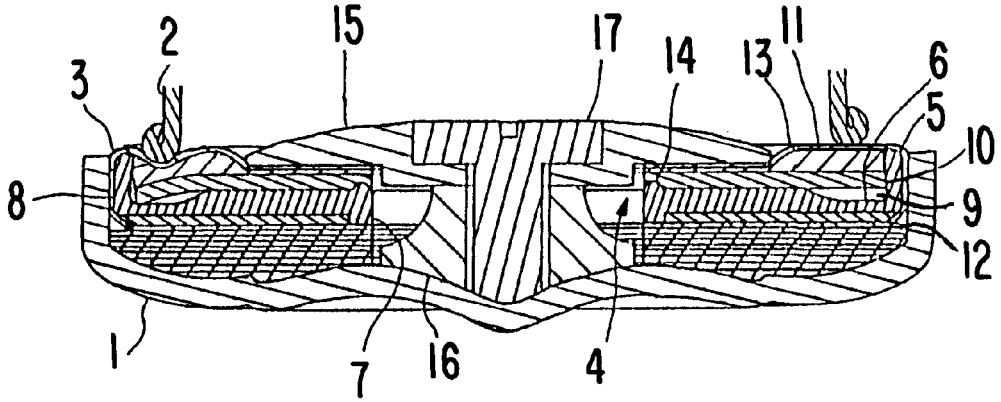
FIG. 2 is a sectional view showing a state in which a distorted tone hole is sealed firmly by the pad of the present invention.
Figure 3:
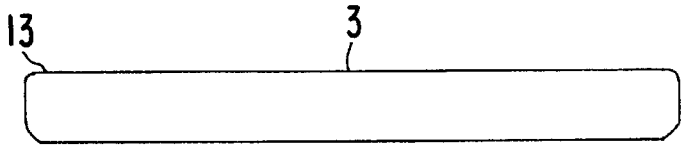
FIG. 3 is a,front view of the pad of the present invention.
Figure 4:
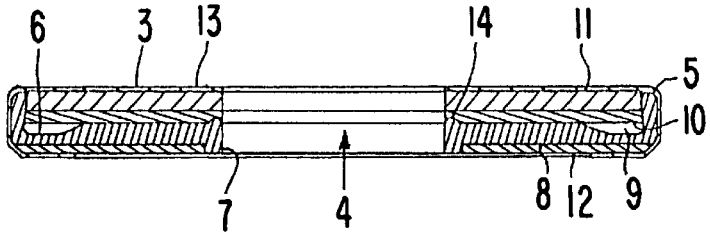
FIG. 4 is a sectional view of the pad of the present invention.
Figure 5:
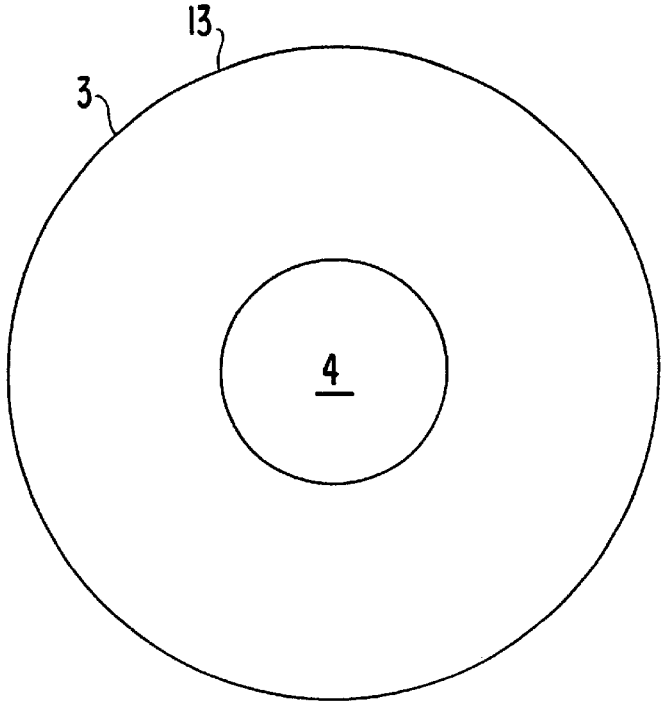
FIG. 5 is a plan view of the pad of the present invention.
Figure 6:
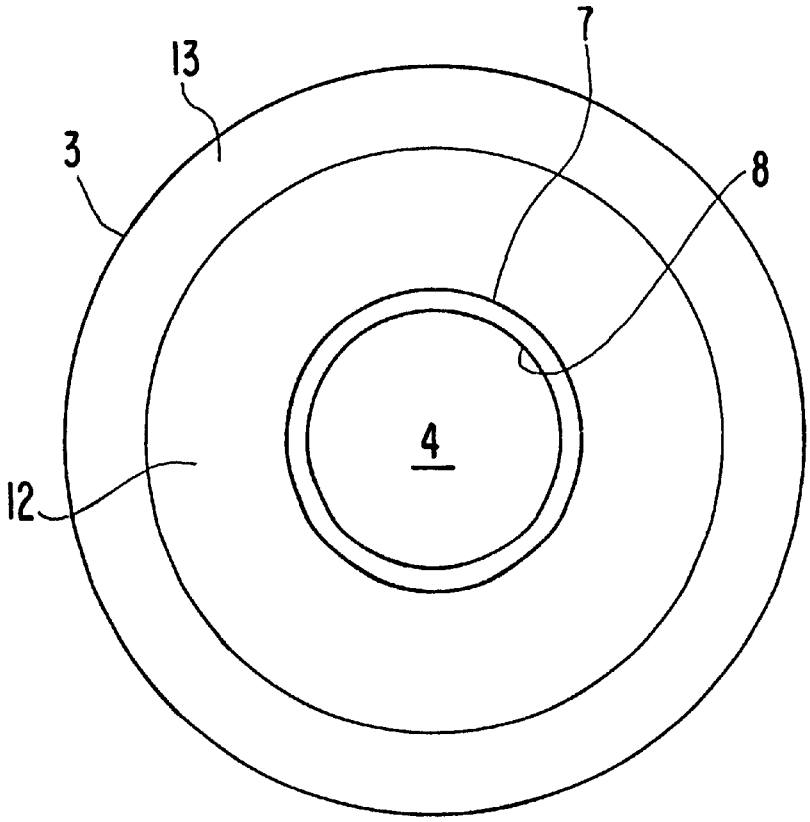
FIG. 6 is a bottom view of the pad of the present invention.
Figure 10:
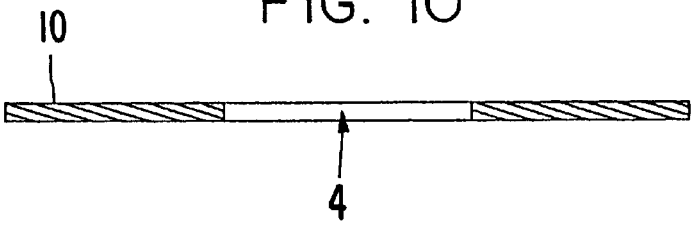
FIG. 10 is a sectional view of a resin plate.

FIG. 10 shows the elastic flat circular resin plate 10. A mounting hole 4 having the same inside diameter as that of the metallic base 8 is formed in the center thereof. An outside diameter thereof is substantially the same as the inside diameter of the rising wall portion 5. The rear surface covers the surface of the metallic base 8 so that it fits firmly thereto, and thereby forms a space portion 9 in the ring-like concave portion 6 when it is inserted inside the metallic base 8. The resin plate 10 is deformed corresponding to a shape of the tone hole 2 and is warped toward the space portion 9 to absorb shock. If pressure diminishes, it is restored to its original shape. As shown in FIG. 2, if the tone hole 2 has a retreated right side and a projected left side, a pad 3 still seals that tone hole completely. According to this embodiment, the pad 3 is made of a silicone resin.

Figure 11:
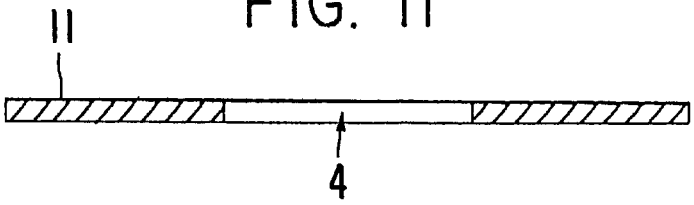
FIG. 11 is a sectional view of a fiber body.

FIG. 11 shows the circular felt-like fiber body 11. A mounting hole 4 having the same inside diameter as that of the resin plate 10 is formed in the center thereof and an outside diameter is substantially the same as the inside diameter of the rising wall portion 5. This fiber body 11 is inserted within the metallic base 8 with its rear surface fitting firmly to the surface of the resin plate 10. Because the fiber body 11 is thin, it slightly deforms against the pressure of the tone hole 2. If further pressure is applied, the fiber body 11 is warped integrally with the resin plate 10, and if the pressure diminishes, it is restored. The fiber body 11 makes a firm contact with the tone hole 2 by the elasticity of the resin plate 10 so as to enhance sealing performance of the pad 3.

Figure 12:
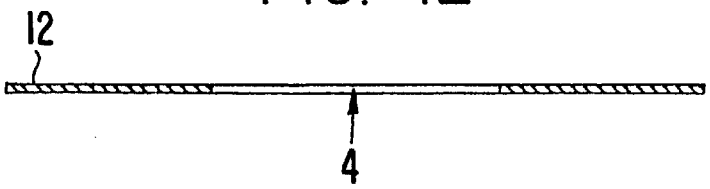
FIG. 12 is a sectional view of a mount paper.

FIG. 12 shows a circular mount paper 12. A mounting hole 4 having the same inside diameter as the outside diameter of the ring-like convex portion 7 on the rear surface of the metallic base 8 is formed in the center thereof and an outside diameter thereof is substantially the same as the outside diameter of the metallic base 8. With the mounting hole 4 fixed to the ring-like convex portion 7, a surface of this mount paper 12 is firmly fitted to the rear surface of the metallic base 8. The mount paper 12 keeps the center of the pad bonded with a pad skin 13 so as to equalize tension to keep the sealing performance of the pad 3 uniform.

Figure 13:
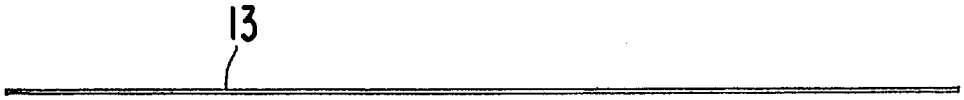
FIG. 13 is a front view of a pad skin.
Figure 14:
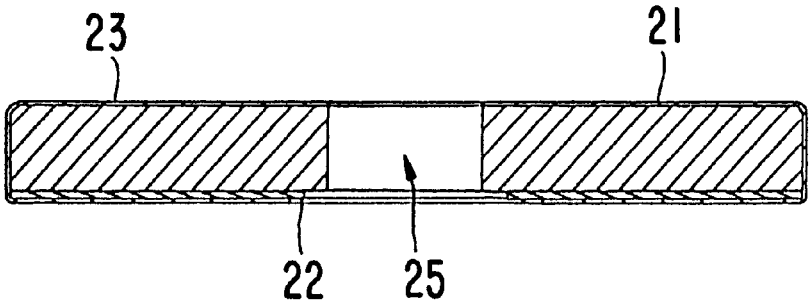
FIG. 14 PRIOR ART
FIG. 14 a sectional view of a conventional pad.
Figure 15:
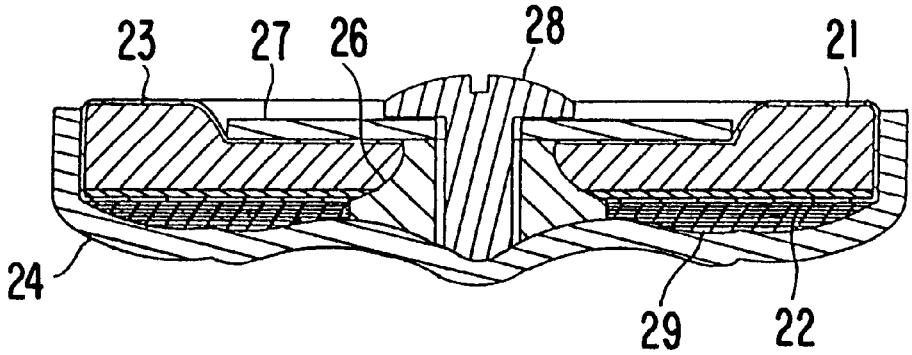
FIG. 15 PRIOR ART
FIG. 15 a sectional view of the conventional pad mounted in a cup.

FIG. 13 shows the pad skin 13 to be glued to the rear surface of the mount paper 12. A mounting hole 4 having the same inside diameter as that of the fiber body is formed in the center thereof. This pad skin 13 wraps the overlaid fiber body 11, resin plate 10, metallic base 8 and mount paper 12 from the surface thereof, keeping a uniform tension. The pad skin 13 comes into direct contact with the tone hole 2. Because the fundamental shape of the pad skin 13 is fixed by the surface of the fiber body 11, the outer peripheral face of the metallic base 8 and the rear surface of the mount paper 12, the shape of the pad skin 13 does not collapse.

Figure 1:
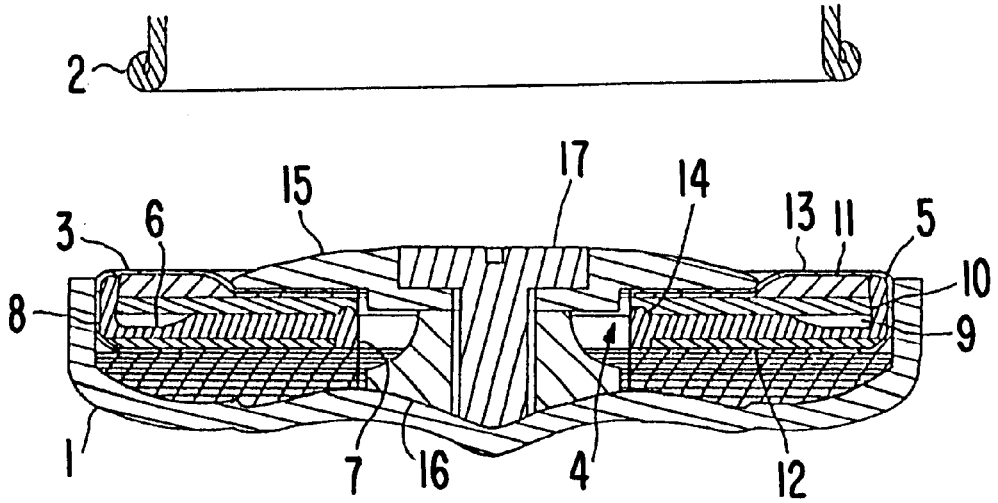
FIG. 1 a sectional view of a pad and a tone hole of the present invention mounted in a cup.

As for the basic mounting method of the pad 3, as shown in FIGS. 1 and 2, a pad nut 16 is inserted into the mounting hole 4 of the pad 3. A pad washer 15 is placed over the surface of the pad 3, and finally, a pad fixing screw 17 is tightened. Any unevenness of the inside face of a cup 1 is adjusted to become a flat surface with paper, resin or the like. Therefore, fine adjustment with an adjustment paper is not necessary.

A ring-like small protrusion 14 is formed on the inside periphery of the flat surface of the metallic base 8. The ring-like small protrusion 14 presses the inner peripheral portions of the resin plate 10 and fiber body 11 against the pad skin 13. If the pad 3 is mounted in a cup 1, the inner peripheral portion of the surface of the pad 3 is strongly pressed against the rear surface of the pad washer 15 so as to prevent an air leakage.

Figure 7:
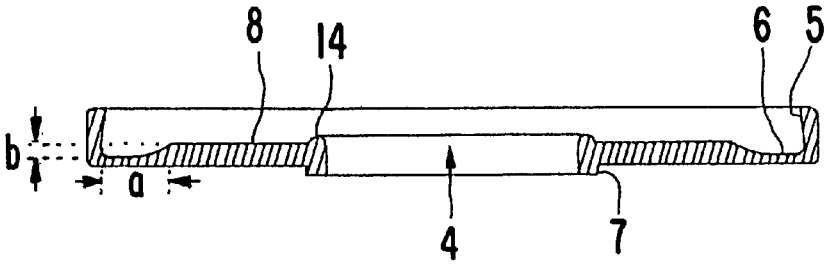
FIG. 7 a sectional view of a metallic base.

The shape of the ring-like concave portion 6 in the metallic base 8 shown in FIG. 7 changes the touch transmitted to the finger of an instrument player. Corresponding to a desire of the instrument player, the following adjustments are carried out. If it is desired to harden the touch, the ring-like concave portion 6 is formed with a narrow width. This shortens the warpage width of the resin plate 10 so as to harden the elastic force. If it is desired to soften the touch, the ring-like concave portion 6 is formed with a wide width. This lengthens the warpage width of the resin plate 10 so as to soften the elastic force. If it is intended to make the touch feel shallow, the depth of the ring-like concave portion 6 is formed shallow. Thus, the range of the resin plate 10 which can deflect into the space portion 9 is made shallow. If it is intended to make the touch feel deep, the depth of the ring-like concave portion 6 is formed deep. Thus, the range of the resin plate 10 which can deflect into the space portion 9 is deepened.

According to the tone hole pad for a musical wind instrument and a method of touch adjustment therefor of the present invention described above, the following effects can be achieved.

In the above described pad for a wind instrument, even if there is distortion in the tone hole, the surface of the pad is elastically deformed to not produce a gap and to seal it completely.

The cup makes a circular motion around a fulcrum of a lever and even if the pad makes contact in a condition in which the top surface of the tone hole is not parallel to the surface of the pad, the surface of the pad is elastically deformed so that it makes firm contact with the top surface of the tone hole so as to not produce any gap. Thus, the tone hole can be sealed completely. Further, because the felt has a thin structure, the thickness of the pad does not change so much to produced an obstacle to the firm contact during the circular motion.

Although the thickness of the pad is not different from the conventional one, because the fiber body has a thin structure occupying only the upper layer, which is part of the three-layer structure constituting the internal configuration of the pad, the sealing performance thereof is not affected by humidity. Further, because of the thin structure, the deformation of the fiber body by physical pressure is small so that the sealing performance is not affected. Because the fiber body absorbs shock integrally with the resin plate and deforms, damage received thereby is small. The rising wall portion inclined inward holds the fiber body and resin plate so as to prevent floating of the outer peripheral ends thereof.

Because the fiber body and resin plate ensure the sealing performance and elasticity separately, a violent (strong) touch is not required, and therefore, the tone hole can be sealed securely with a light touch. Thus, the force of the finger during playing may be small. Because the tone hole can be opened/closed with a light touch and the resin plate absorbs shock caused between the pad and tone hole, noise is not produced. Further, because the tone hole can be sealed with such a light touch, players can obtain a feeling that the tone hole is sealed completely through their fingers.

The ring-like small protrusion formed on the metallic base presses the resin plate and the resin plate presses the pad skin. Therefore, when the pad is mounted in the cup, the ring-like small protrusion presses the inner peripheral portion of the surface of the pad against the rear surface of the pad washer strongly so as to reduce air leakage.

The ring-like protrusion maintains the center of the mount paper at a normal position. The pad skin maintains a predetermined shape with the surface of the wrapped fiber body, the outer peripheral face of the rising wall portion and the rear surface of the mount paper on which the pad skin is glued so as to maintain uniform tension, and thereby keep the shape of the pad.

Because the metallic base is solid and it is not deformed by pressure of the pad washer so that the shape of the pad is maintained, the tone hole can be sealed without any gap. Because the tone hole is sealed completely with the pad so that no air leakage occurs, an accurate sound can be produced. Because the resin plate is deformed corresponding to the shape of the tone hole, fine adjustments requiring skill are not necessary. Even if the tone hole is distorted in any shape, it can be sealed. Additionally, anyone can mount the pad by only fixing it in the cup with a screw. An accurate sound can be produced at any time without fine adjustments. If the pad is worn due to long term use, it can be easily replaced with a new one.

Depending on a player's desire, it is possible to adjust the touch by forming the width of the ring-like concave portion to be narrow to shorten the warpage width of the resin plate and thereby make a solid touch. Widening the width of the ring-like concave portion lengthens the warpage width of the resin plate and thereby makes a soft touch. Making the depth of the ring-like concave portion shallow makes a shallow touch. Making the depth of the ring-like concave portion deep makes a deep touch. These adjustments can be made by modifying the concave portion, by replacing components of the tone hole pad, or by replacing the entire tone hole pad.

What is claimed:

1. A tone hole pad of a wind instrument for opening and closing a tone hole which has a shape, comprising:

a circular metallic base, wherein said metallic base has
- a center,
- a hole formed at said center of said metallic base and having a hole diameter,
- a flat surface having an inner peripheral portion and an outer peripheral portion,
- a rising wall portion formed around said outer peripheral portion of said flat surface, wherein said rising wall portion has an inside diameter larger than the tone hole and said rising wall portion has an outer peripheral face,
- a ring-shaped concave portion formed in said metallic base having an outside diameter inside said rising wall portion, an inside diameter smaller than the tone hole, a width, and a depth,
- a flat rear surface having an inner peripheral portion,
- a ring-shaped convex portion formed at said inner peripheral portion of said flat rear portion, wherein said ring-shaped convex portion has an outside diameter, and
- an outer diameter;

an elastic flat circular resin plate provided inside said metallic base, wherein said resin plate has
- a center,
- a hole formed in said center of said resin plate, wherein said hole of said resin plate has a hole diameter equal to said hole diameter of said metallic base,
- an outer diameter substantially equal to said inside diameter of said of rising wall portion of said metallic base, and
- a rear face fitted to said flat surface of said metallic base to cover said flat surface, wherein said resin plate is elastic to absorb shock when said resin plate is deformed in order to conform to the shape of the tone hole when closed;

a space portion formed between said resin plate and said concave portion of said metallic base, wherein said space portion allows for deformation of said resin plate;

a circular fiber body provided inside said metallic base, wherein said fiber body has
- a center
- a hole formed in said center of said fiber body, wherein said hole of said fiber body has a hole diameter equal to said hole diameter of said resin plate,
- an outer diameter substantially equal to said inside diameter of said of rising wall portion of said metallic base, and
- a rear face fitted to said resin plate;

a circular mount paper fitted to said flat rear surface of said metallic base, wherein said mount paper has
- a center,
- a hole formed in said center of said mount paper, wherein said hole of said mount paper has a hole diameter equal to said outside diameter of said ring-shaped convex portion of said metallic base, wherein said ring-shaped convex portion maintains said center of said mount paper in position, an outer diameter substantially equal to said outer diameter of said metallic base, and a rear sure away from said metallic base; and a pad skin glued to said rear surface of said mount paper, wherein said pad skin has a center, and a hole formed in said center of said pad skin, wherein said hole of said pad skin has a hole diameter substantially equal to said hole diameter of said fiber body, wherein said pad skin is wrapped around said fiber body, said resin plate, said metallic base, and said mount paper in order to hold a predetermined shape so as to maintain a uniform tension in said pad skin.

2. The tone hole pad of claim 1, wherein said rising wall portion is inclined inward, wherein said rising wall portion has an inclined inside face having an upper portion with an inside diameter and a bottom portion with an inside diameter, wherein said inside diameter of said upper portion is smaller than said inside diameter of said bottom portion, and wherein said inclined inside face holds said resin plate and said fiber body to prevent said resin plate and said fiber body from floating.

3. The tone hole pad of claim 2, further comprising a ring-shaped protrusion formed on said inner peripheral portion of said flat surface of said metallic base, and a pad washer having a rear surface, wherein said pad skin has an inner peripheral portion and said protrusion presses said inner peripheral portion of said pad skin against said rear surface of said pad washer in order to prevent air leakage.

4. The tone hole pad of claim 1, further comprising a ring-shaped small protrusion formed on said inner peripheral portion of said flat surface of said metallic base, and a pad washer having a rear surface, wherein said pad skin has an inner peripheral portion and said protrusion strongly presses said inner peripheral portion of said pad skin against said rear surface of said pad washer so as to prevent air leakage.

5. A method of adjusting touch for a wind instrument, comprising:

providing a tone hole pad comprising a base and an elastic plate provided inside said base, and wherein said base has a ring-shaped concave portion; and changing dimensions of said ring-shaped concave portion in order to adjust deflection of said elastic plate;

wherein said changing dimensions includes narrowing a width of said ring-shaped concave portion in order to reduce a warpage width of said elastic plate.

6. A method of adjusting touch for a wind instrument, comprising:

providing a tone hole pad comprising a base and an elastic plate provided inside said base, and wherein said base has a ring-shaped concave portion; and changing dimensions of said ring-shaped concave portion in order to adjust deflection of said elastic plate;

wherein said changing dimensions includes widening a width of said ring-shaped concave portion in order to increase a warpage width of said elastic plate.

7. A method of adjusting touch for a wind instrument, comprising:

providing a tone hole pad comprising a base and an elastic plate provided inside said base, and wherein said base has a ring-shaped concave portion; and changing dimensions of said ring-shaped concave portion in order to adjust deflection of said elastic plate;

wherein said changing dimensions includes reducing a depth of said ring-shaped concave portion in order to reduce deflection of said elastic plate.

8. A method of adjusting touch for a wind instrument, comprising:

providing a tone hole pad comprising a base and an elastic plate provided inside said base, and wherein said base has a ring-shaped concave portion; and changing dimensions of said ring-shaped concave portion in order to adjust deflection of said elastic plate;

wherein said changing dimensions includes increasing a depth of said ring-shaped concave portion in order to increase deflection of said elastic plate.

9. A method of adjusting touch for a wind instrument, comprising: providing a tone hole pad mountable within a cup, the pad comprising:

a circular metallic base, wherein said metallic base has a center, a hole formed at said center of said metallic base and having a hole diameter, a flat surface having an inner peripheral portion and an outer peripheral portion, a rising wall portion formed around said outer peripheral portion of said flat surface, wherein said rising wall portion has an inside diameter larger than the tone hole and said rising wall portion has an outer peripheral face, a ring-shaped concave portion formed in said metallic base having an outside diameter inside said rising wall portion, an inside diameter smaller than the tone hole, a width, and a depth, a flat rear surface having an inner peripheral portion, a ring-shaped convex portion formed at said inner peripheral portion of said flat rear portion, wherein said ring-shaped convex portion has an outside diameter, and an outer diameter;

an elastic flat circular resin plate provided inside said metallic base, wherein said resin plate has a center, a hole formed in said center of said resin plate, wherein said hole of said resin plate has a hole diameter equal to said hole diameter of said metallic base, an outer diameter substantially equal to said inside diameter of said of rising wall portion of said metallic base, and a rear face fitted to said flat surface of said metallic base to cover said flat surface, wherein said resin plate is elastic to absorb shock when said resin plate is deformed in order to conform to the shape of the tone hole when closed;

a space portion formed between said resin plate and said concave portion of said metallic base, wherein said space portion allows for deformation of said resin plate;

a circular fiber body provided inside said metallic base, wherein said fiber body has a center a hole formed in said center of said fiber body, wherein said hole of said fiber body has a hole diameter equal to said hole diameter of said resin plate, an outer diameter substantially equal to said inside diameter of said of rising wall portion of said metallic base, and a rear face fitted to said resin plate;

a circular mount paper fitted to said flat rear surface of said metallic base, wherein said mount paper has a center, a hole formed in said center of said mount paper, wherein said hole of said mount paper has a hole diameter equal to said outside diameter of said ring-shaped convex portion of said metallic base, wherein said ring-shaped convex portion maintains said center of said mount paper in position, an outer diameter substantially equal to said outer diameter of said metallic base, and a rear surface away from said metallic base; and a pad skin glued to said rear surface of said mount paper, wherein said pad skin has a center, and a hole formed in said center of said pad skin, wherein said hole of said pad skin has a hole diameter substantially equal to said hole diameter of said fiber body, wherein said pad skin is wrapped around said fiber body, said resin plate, said metallic base, and said mount paper in order to in order to hold a predetermined shape so as to maintain a uniform tension in said pad skin; and changing at least one of width and depth dimensions of said ring-shaped concave portion during manufacture in order to adjust deflection width and deflection depth of said elastic plate.

* * * * *